US010338495B2

(12) United States Patent
Motohashi

(10) Patent No.: US 10,338,495 B2
(45) Date of Patent: Jul. 2, 2019

(54) IMAGE FORMING APPARATUS

(71) Applicant: CANON KABUSHIKI KAISHA, Tokyo (JP)

(72) Inventor: Satoru Motohashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/897,932

(22) Filed: Feb. 15, 2018

(65) Prior Publication Data

US 2018/0239274 A1 Aug. 23, 2018

(30) Foreign Application Priority Data

Feb. 22, 2017 (JP) ..... 2017-031353

(51) Int. Cl.

| | |
|---|---|
| ***G03G 15/08*** | (2006.01) |
| ***G03G 21/12*** | (2006.01) |
| ***G03G 15/00*** | (2006.01) |
| ***G03G 21/00*** | (2006.01) |
| ***G03G 21/18*** | (2006.01) |

(52) U.S. Cl.

CPC ..... *G03G 15/0844* (2013.01); *G03G 15/0865* (2013.01); *G03G 15/5062* (2013.01); *G03G 15/556* (2013.01); *G03G 21/0011* (2013.01); *G03G 21/0094* (2013.01); *G03G 21/12* (2013.01); *G03G 21/1814* (2013.01); *G03G 15/50* (2013.01); *G03G 2215/066* (2013.01); *G03G 2221/1838* (2013.01)

(58) Field of Classification Search

CPC ..... G03G 21/0011; G03G 21/0094; G03G 21/12; G03G 2221/1838

See application file for complete search history.

(56) References Cited

U.S. PATENT DOCUMENTS

| | | | | |
|---|---|---|---|---|
| 5,956,541 | A | 9/1999 | Hoshika | |
| 2004/0240903 | A1* | 12/2004 | Saida | G03G 15/205 399/69 |
| 2007/0201897 | A1* | 8/2007 | Maeda | G03G 15/161 399/101 |
| 2011/0013959 | A1* | 1/2011 | Thayer | G03G 21/0005 399/346 |
| 2011/0150512 | A1* | 6/2011 | Tamagaki | G03G 21/0094 399/53 |
| 2011/0150547 | A1 | 6/2011 | Hirata | |
| 2014/0169821 | A1 | 9/2014 | Ichinose | |
| 2016/0231665 | A1 | 8/2016 | Shinkawa | |

FOREIGN PATENT DOCUMENTS

| | | |
|---|---|---|
| EP | 2293148 A2 | 3/2011 |
| JP | 2011150304 A | 8/2011 |

* cited by examiner

*Primary Examiner* — Carla J Therrien

(74) *Attorney, Agent, or Firm* — Canon U.S.A., Inc. IP Division

(57) ABSTRACT

There is demand to reduce the amount of developing agent fed to a cleaning member. The amount of developing agent that is fed to the cleaning member is decided based on the amount of developing agent recovered by the cleaning member or the amount of use of a process cartridge.

20 Claims, 11 Drawing Sheets

IMAGE FORMING APPARATUS

BACKGROUND OF THE INVENTION

Field of the Invention

The present invention relates to an image forming apparatus that forms images on a recording material.

Description of the Related Art

The present invention relates to an image forming apparatus such as copiers, printers, facsimile devices, and so forth using electrophotography or electrostatic recording. Image forming apparatuses are configured having a developing portion formed as a detachably mountable developing cartridge in some cases, and are configured having an image bearing member and processes thereof integrated as a process cartridge in some cases, to facilitate maintenance.

There is known an arrangement to remove developing agent, remaining on the image bearing member after a developed image formed on the image bearing member has been transferred onto the recording medium, where a cleaning member is brought into contact with the surface of the image bearing member to remove the residual developing agent. A configuration of an elastic member made of urethane rubber or the like and a supporting member supporting the elastic member is widely used as the cleaning member. There have been cases in this configuration where increased friction force between the cleaning member and the image bearing member leads to unstable behavior of the cleaning member, resulting in the cleaning member peeling back or chattering, causing abnormal noise (Japanese Patent Laid-Open No. 2011-150304).

Japanese Patent Laid-Open No. 2011-150304 proposes a method where developing agent is supplied from a developing device side to the cleaning member via the image bearing member, thereby reducing friction force between the two and maintaining lubricity, as a way to counter this problem. Although the method described in Japanese Patent Laid-Open No. 2011-150304 is effective in addressing the above-described problem, the developing agent fed to the cleaning member side is recovered into a cleaner case, and accordingly cannot be used for image formation. If the amount of developing agent fed to the cleaning member becomes great, the number of prints that the user can make thus decreases in proportion. Accordingly, there is demand for an image forming apparatus where the amount of developing agent fed to the cleaning member can be reduced.

SUMMARY OF THE INVENTION

The present invention provides an image forming apparatus that includes: a cleaning cartridge including an image bearing member, and a cleaning member configured to come into contact with the image bearing member and clean the image bearing member; a developing cartridge having a developing agent bearing member configured to convey developing agent to the image bearing member; and a control unit configured to execute a supply process of developing agent supplied from the developing cartridge to the cleaning member via the image bearing member during a non-image-forming period. The cleaning cartridge and the developing cartridge are each detachably mounted to an apparatus main body of the image forming apparatus. The control unit decides a supply amount of the developing agent supplied from the developing cartridge to the cleaning member in the supplying process of the developing agent, based on a value relating to an amount of developing agent recovered by the cleaning member and a value relating to a usage amount of the developing cartridge.

The present invention also provides an image forming apparatus that includes: a process cartridge including an image bearing member, a cleaning member configured to come into contact with the image bearing member and clean the image bearing member, and a developing agent bearing member configured to convey developing agent to the image bearing member; a toner cartridge configured to supply developing agent to the image bearing member; and a control unit configured to execute a supply process of developing agent supplied from the developing agent bearing member to the cleaning member via the image bearing member during a non-image-forming period. The process cartridge is detachably mounted to an apparatus main body of the image forming apparatus. The control unit decides a supply amount of the developing agent supplied from the developing agent bearing member to the cleaning member in the supplying process of the developing agent, based on a value relating to an amount of developing agent recovered by the cleaning member and a value relating to a usage amount of the toner cartridge.

Further features of the present invention will become apparent from the following description of exemplary embodiments with reference to the attached drawings.

DESCRIPTION OF THE EMBODIMENTS

Embodiments of the present invention will be exemplarily described with reference to the drawings. It should be noted that dimensions, materials, shapes, relative positions, and so forth, of components described in the embodiments should be changed as appropriate in accordance with configurations of apparatuses to which the present invention is to be applied, and various conditions. The embodiments described below do not restrict the scope of the present invention. Each of the embodiments of the present invention described below can be implemented solely or as a combination of a plurality of the embodiments or features thereof where necessary or where the combination of elements or features from individual embodiments in a single embodiment is beneficial.

First Embodiment

Image Forming Apparatus

Figure 1:
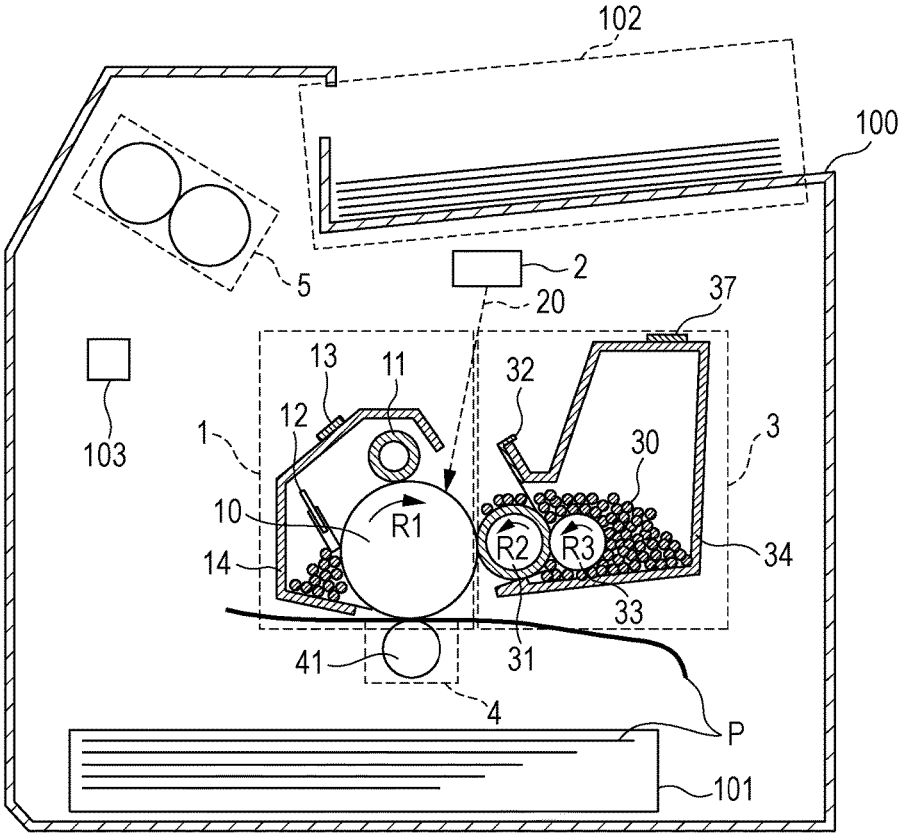
FIG. 1 is a diagram for describing an image forming apparatus according to a first embodiment.

The configuration of an image forming apparatus according to a first embodiment with reference to FIG. 1. The image forming apparatus according to the present embodiment includes an apparatus main body 100 that has at least a cleaning cartridge (photosensitive member unit) 1, an exposing device 2, a developing cartridge (developing unit) 3, a transfer device 4, and a fixing device 5, therein. The cleaning cartridge (photosensitive member unit) 1 and developing cartridge (developing unit) 3 are independently detachably mounted to the apparatus main body 100.

The cleaning cartridge 1 includes a photosensitive drum 10 that is an image bearing member, a charging roller 11 that is a charging member, a cleaning blade 12 that is a cleaning member, and a storage element 13. There are two cartridges in the present embodiment, so the storage element 13 that the cleaning cartridge 1 has will be referred to as a first storage element, and a later-described storage element 37 that the developing cartridge 3 has will be referred to as a second storage element.

The developing cartridge 3 according to the present embodiment contains a negatively-charging single-component developing agent (hereinafter referred to as "toner") 30. The developing cartridge 3 includes a developing roller 31 that is a developing agent bearing member, a developing blade 32 that is a developing agent regulating member, a supply roller 33 that supplies toner to the developing agent bearing member, and the storage element 37 that is non-volatile memory or the like.

A control unit 103 is configured including a central processing unit (CPU) to centrally perform computation processing, and is configured including read only memory (ROM), random access memory (RAM), and so forth, which are storage elements. The RAM stores detection results of sensors, computation results, and so forth, and the ROM stores control programs, data tables obtained beforehand, and so forth.

The control unit 103 is a control unit that centrally controls operations of the apparatus main body 100. The control unit 103 controls exchange of various types of electric information signals, timings of driving, and so forth, and governs later-described sequences. The objects of control in the apparatus main body 100 are connected to the control unit 103. For example, the control unit 103 is electrically connected to driving units, power source units, and so forth, that operate the cleaning cartridge 1, developing cartridge 3, exposing device 2, transfer device 4, and fixing device 5, and various types of sensor output lines, the storage elements 13 and 37, and so forth.

The cleaning cartridge 1 and developing cartridge 3 are independently detachably mounted in the present embodiment, so when the user is notified of "toner level low", just the developing cartridge 3 is replaced. In the same way, when notified of "drum lifetime" (or any suitable message), just the cleaning cartridge 1 is replaced. According to this configuration, each of the cartridges can be efficiently used until the lifespan has been expended, which is advantageous. The lifespan of the image bearing member has become longer, so around two to five developing cartridges 3 can be used for each cleaning cartridge 1.

Image Forming Process

The charging roller 11 uniformly charges the surface of the photosensitive drum 10, as preparation to form an electrostatic image (or electrostatic latent image) on the surface of the rotatable cylindrical photosensitive drum 10. The charging roller 11 that is a charging member is rotatable on a rotation axis, is in contact with the photosensitive drum 10 and rotates being driven by rotation of the photosensitive drum 10. Charging voltage is applied to the charging roller 11 from a charging voltage applying unit within the apparatus main body 100, whereby the surface of the photosensitive drum 10 is uniformly charged.

The exposing device 2 forms an electrostatic latent image on the uniformly-charged photosensitive drum 10. A laser beam scanner including a laser diode, polygonal mirror, and so forth, is used as an exposing member. The laser beam scanner outputs a laser beam 21 that is intensity-modulated in accordance with image signals of target image information, and the charged surface of the photosensitive drum 10 is exposed by being scanned thereby, thus forming an electrostatic latent image.

The developing cartridge 3 that is a developing device contains toner 30 within a developing frame 34. Developing operations are performed by conveying toner 30 on the developing roller 31 that is rotatable on a rotation axis to the electrostatic latent image formed on the surface of the photosensitive drum 10. Developing voltage is applied to the developing roller 31 from a developing bias power source serving as a developing voltage applying unit, thereby manifesting the electrostatic latent image to which the developing agent was conveyed as a visible image.

The transfer device 4 is a device for transferring a toner image on the surface of the photosensitive drum 10 to a recording medium P. The recording medium P is conveyed from a sheet supply cassette 101 in synch with formation of the toner image, and voltage is applied from a transfer bias power source to a transfer roller 41 serving as a transfer unit. The toner image on the surface of the photosensitive drum 10 is transferred to the recording medium P by the voltage applied to the transfer roller 41. At this time, the greater part of the toner image is transferred onto the recording medium P, but some is not completely transferred onto the recording medium P and remains on the photosensitive drum 10.

The fixing device 5 fixes the toner image onto the recording medium P to which it has been transferred, using heat and pressure, so as to be fixed onto the recording medium P as a fixed image. The recording medium P is then discharged to and stacked on a sheet discharge tray 102 outside of the apparatus main body 100.

The cleaning blade 12 serving as a cleaning member comes into contact with the photosensitive drum 10 at a predetermined pressure, and scrapes off toner that remains on the photosensitive drum 10 due to not being completely transferred to the recording medium P. This toner is accumulated within a cleaning frame 14. Accordingly, the surface of the photosensitive drum 10 is refreshed. These processes are repeated in the same way thereafter, thereby formation of images is continued.

Cleaning Cartridge

Figure 2:
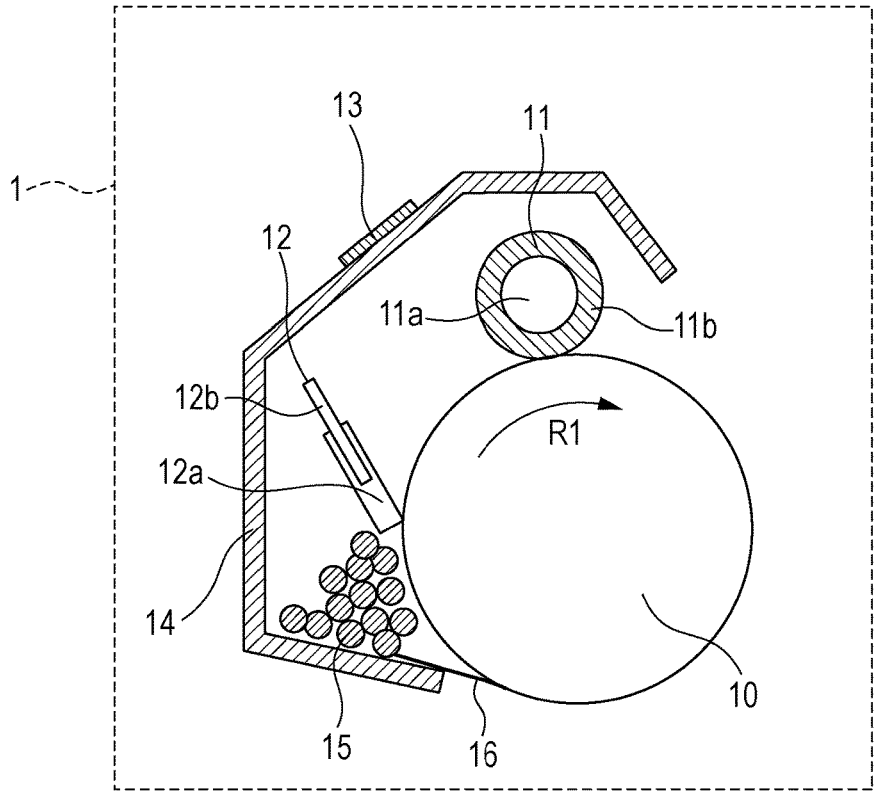
FIG. 2 is a cross-sectional view for describing a cleaning cartridge according to the first embodiment.
Figure 3:
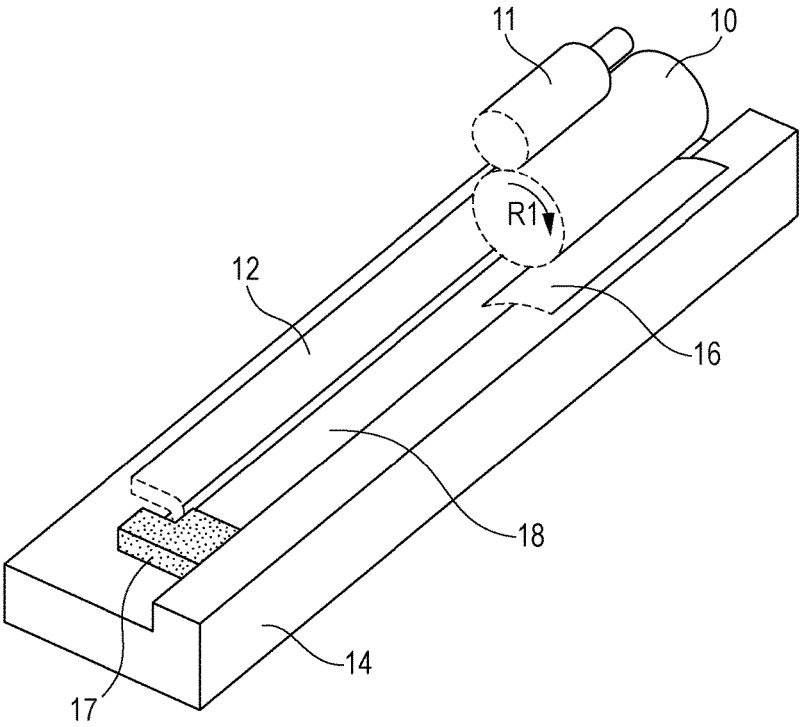
FIG. 3 is a perspective view for describing the cleaning cartridge according to the first embodiment.

The configuration of the cleaning cartridge 1 according to the first embodiment will be described with reference to FIGS. 2 and 3. Some of the members situated toward the front have been drawn partially cut away in FIG. 3, for description of the layout of the members. FIG. 2 is a cross-sectional view of the cleaning cartridge 1.

A negatively-charging photosensitive member, 24 mm in diameter, is used for the photosensitive drum 10. The photosensitive drum 10 is rotatable in the direction of the arrow R1, and is rotationally driven at a surface speed of 100 mm/sec by a driving motor inside the apparatus main body 100. The charging roller 11 is configured by a core portion 11*a* that is 6 mm in diameter being covered by a rubber layer 11*b* that is 1 mmm thick. The charging roller 11 is rotatable centered on the core portion 11*a*, and is in contact with the photosensitive drum 10 under pressure, by 200 to 600 gf/cm of force applied at both ends. The charging voltage applied from the charging voltage applying unit within the apparatus main body 100 is set to a value where the potential difference between the surface of the photosensitive drum 10 and the charging roller 11 is a discharge start voltage, with DC voltage of −1000 to −1100 V being applied. At this time, the surface potential Vd of the photosensitive drum 10 is uniformly charged to Vd=−450 V. The cleaning blade 12 is formed by urethane rubber 12*a*, which is 2 mm thick and has a hardness of 60 to 80 points when measured by a rubber durometer MD-1 at a temperature of 23° C., being integrally supported by a cleaning support metal plate 12*b*. The cleaning blade 12 is fixed to the cleaning frame 14, such that the tip of the urethane rubber 12*a* is in contact with the photosensitive drum 10 at a pressure around 70 gf/cm. The free end of the urethane rubber 12*a* of the cleaning blade 12 scrapes residual toner that was not transferred and remains on the surface photosensitive drum 10. The toner 15 that has been scraped off by the cleaning blade 12 (hereinafter referred to as "waste toner") is accommodated in the cleaning frame 14. Part of the waste toner is retained at the tip of the free end of the urethane rubber 12*a*, providing lubricity between the photosensitive drum 10 and the urethane rubber 12*a*, and stabilizing cleaning performance. The amount of waste toner accommodated in the cleaning frame 14 is calculated by predicting transfer efficiency and the amount of fogging on solid while portions, from the total number of pixels to be printed and the usage environment. The results are stored in the storage element 13. The storage element 13 also stores information such as the number of rotations of the photosensitive drum 10, manufacturing No., and so forth, which can be used to comprehend the usage state of the cleaning cartridge 1. When the number of rotations of the photosensitive drum 10 or the amount of waste toner accommodated in the cleaning frame 14 exceeds a threshold value, the lifespan of the cleaning cartridge 1 is determined to have ended, the user is notified to this effect, and the cleaning cartridge 1 is replaced with a new cleaning cartridge 1. The lifespan of the cleaning cartridge 1 may be calculated based on the amount of use of the photosensitive drum 10 serving as an image bearing member. For example, threshold values corresponding to the lifespan of the photosensitive drum 10 may be set based on the driving time and number of rotations of the photosensitive drum 10, and notification may be made that the lifespan of the cleaning cartridge 1 has ended in a case where the driving time and number of rotations exceed the threshold value. In such a case, a configuration is conceivable where the cleaning cartridge 1 itself does not accommodate the waste toner, and a waste toner container is separately provided to the apparatus main body 100.

Next, the configuration around the cleaning frame 14 will be described with reference to FIG. 3. The cleaning blade 12 scrapes the residual toner off of the surface of the photosensitive drum 10. The toner that has been scraped off is accumulated in the cleaning frame 14 through a cleaning opening 18 that is defined by the cleaning frame 14, a scooping sheet 16, and a cleaning end seal 17. The scooping sheet 16 is a flexible sheet member that prevents toner leakage from the cleaning frame 14 by being in close contact with the photosensitive drum 10 and the cleaning end seal 17. The cleaning end seal 17 is an elastic member where a surface thereof that comes into contact with the photosensitive drum 10 has been subjected to flocking with minute flock, and comes into close contact with the photosensitive drum 10, cleaning blade 12, scooping sheet 16, and cleaning frame 14. This close contact prevents toner leakage from the end portion of the cleaning frame 14.

Developing Cartridge

Figure 4:
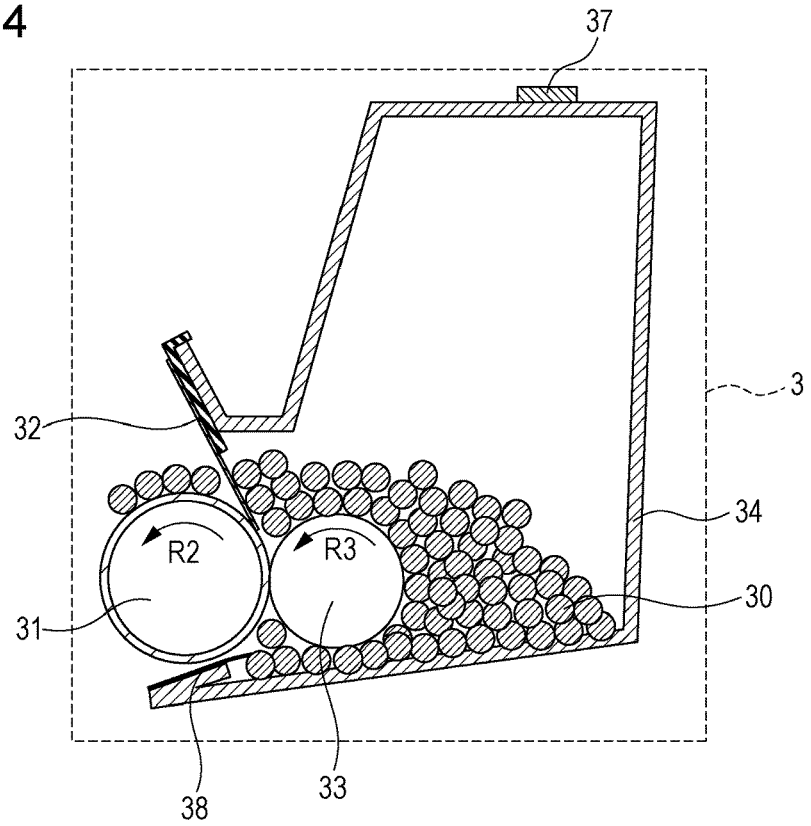
FIG. 4 is a cross-sectional view for describing a developing cartridge according to the first embodiment.
Figure 5:
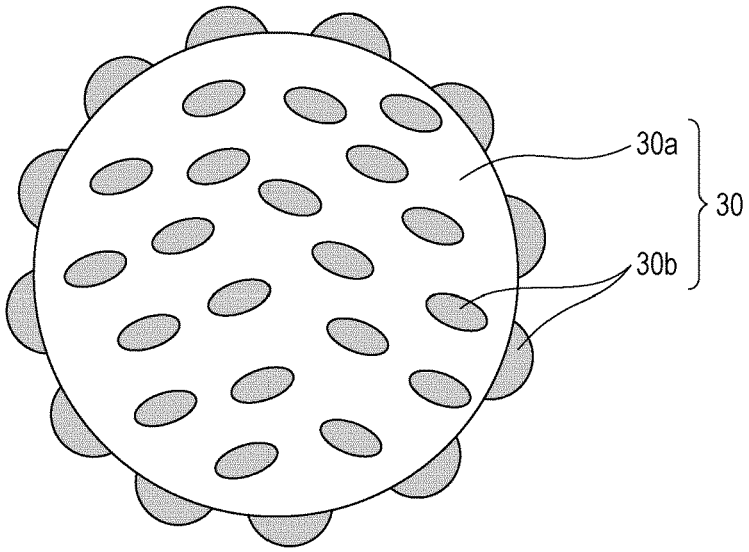
FIG. 5 is a diagram for describing toner according to the first embodiment.
Figure 6:
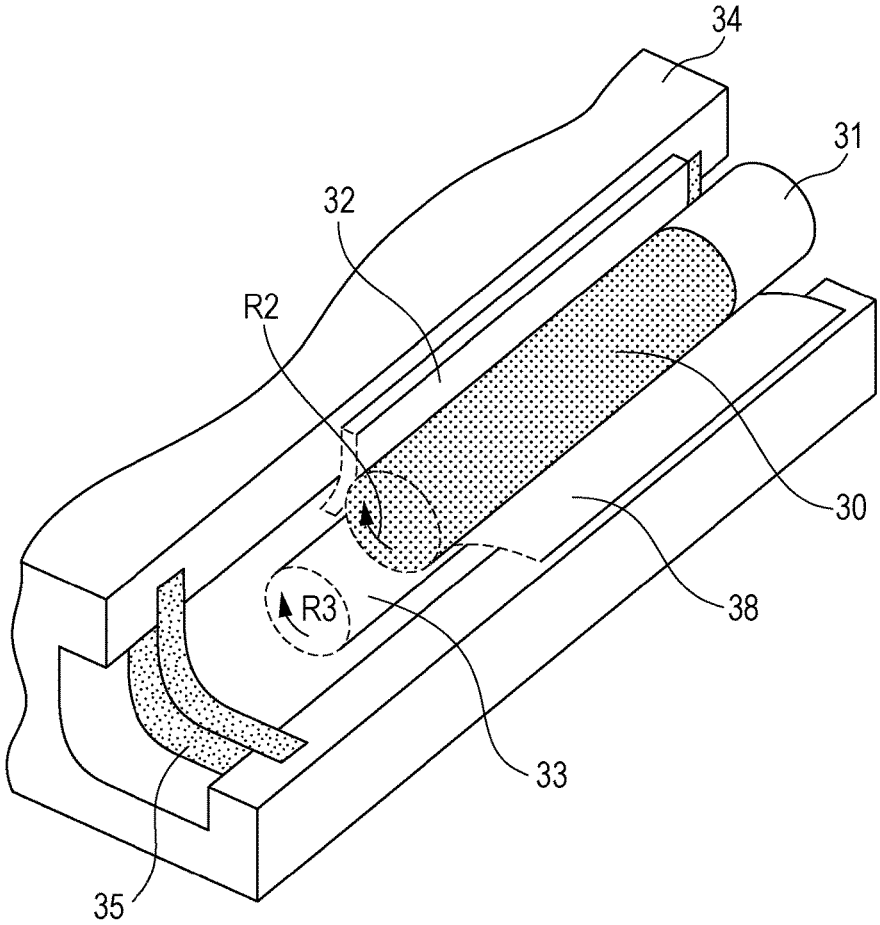
FIG. 6 is a cross-sectional view for describing the developing cartridge according to the first embodiment.

The configuration of the developing cartridge 3 according to the first embodiment will be described with reference to FIGS. 4 through 6. Some of the members situated toward the front have been drawn partially cut away in FIG. 6, for description of the layout of the members.

Negatively-charging non-magnetic single-component toner is used for the toner 30. Toner particles have a configuration where external additives 30*b* that is inorganic particles such as lubricants, charge-controlling agents, and so forth, have been added to resin particles 30*a* including charge-controlling agents, pigments, and so forth, serving as a base. These are contained (accommodated) in a developing frame 34, as illustrated in FIG. 4. The developing roller 31 is a roller member that can rotate in the direction of the arrow R2. The developing roller 31 serves to bear toner 30 and convey the toner 30 to the electrostatic latent image on the photosensitive drum 10. The developing blade 32 is a stainless-steel plate that comes into contact with the developing roller 31 under a predetermined pressure, and regulates the amount of toner (or thickness of the toner layer) on the developing roller 31 to a generally constant amount (or thickness). The toner 30 is negatively charged by friction at the time of the toner amount being regulated. The supply roller 33 is a roller member formed of a sponge material that absorbs the toner 30, and rotates in the direction of the arrow R3 while in contact with the developing roller 31. This rotation supplies the toner 30 to the surface of the developing roller 31. A blowout prevention sheet 38 is a flexible sheet member that prevents toner leakage from the developing frame 34 by being in close contact with the developing roller 31 and a developing end seal 35. The developing end seal 35 is an elastic member where a surface thereof that comes into contact with the developing roller 31 has been subject to flocking with minute flock. The developing end seal 35 comes into close contact with the developing roller 31, developing blade 32, blowout prevention sheet 38, and developing frame 34, thereby preventing toner leakage from the end portion of the developing frame 34.

In order to find the toner amount, which is the amount of developing agent in the developing frame 34, an arrangement is used in which the number of pixels regarding which the exposing device 2 emits light can be counted in the present embodiment (hereinafter referred to as "pixel count"). The amount of toner necessary to develop an image of a certain number of pixels can be calculated by the number of pixels regarding which light is emitted. Accordingly, using this pixel count method enables the amount of toner that has been consumed to be calculated, and subtracting this value from the initial toner filling amount gives the amount of toner remaining in the developing frame 34. This value is stored in the storage element 37. The storage element 37 stores the number of rotations of the developing roller 31 and so forth in addition to the remaining amount of toner, so the usage state of the developing cartridge 3 can be comprehended from the information in the storage element 37. When the number of rotations of the developing roller 31 or the amount of waste toner exceeds a threshold value, the lifespan of the developing cartridge 3 is determined to have ended, which is notified to the user, and is replaced with a new developing cartridge 3.

Although a method of counting the number of pixels is used in the present embodiment to calculate the amount of developing agent remaining accommodated in the developing frame 34, this method is not restrictive. For example, there is an optical remaining amount detecting method where light is passed through the developing frame 34, and the remaining amount of developing agent is judged by the light being shielded by the presence of developing agent. Further, an electrostatic capacitance detection method may be used, where a pair of electrodes are installed, and the amount of developing agent is judged based on change in electrostatic capacitance between the electrodes.

Toner Supply Operations in Non-Image-Forming Period (Toner Supply (Purge) Process)

Figure 7:
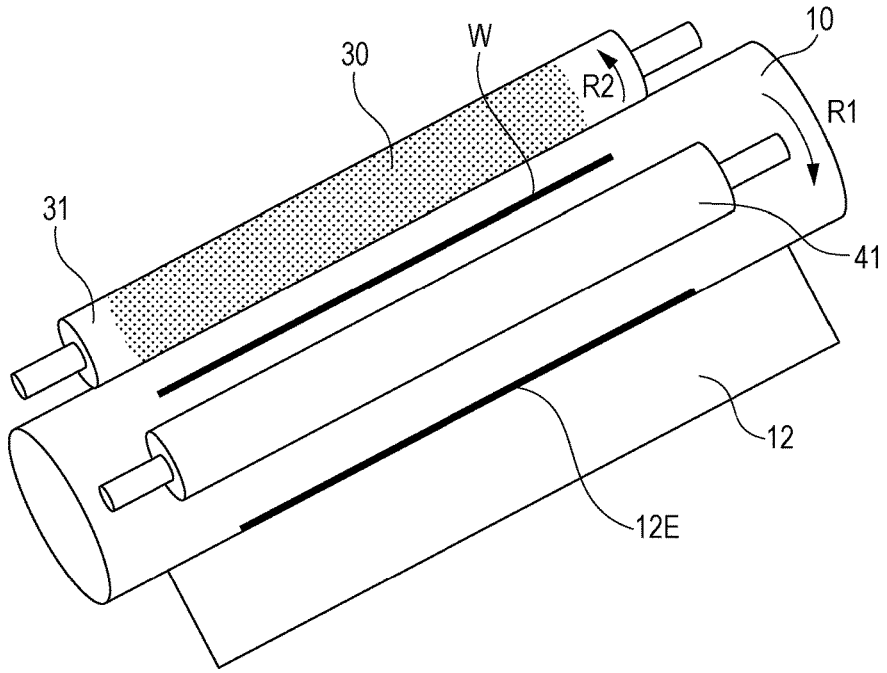
FIG. 7 is a diagram for describing a toner supply (purging) process according to the first embodiment.

Next, toner supply operations in a non-image-forming period (hereinafter, this operation will be referred to as "toner supply (purge) process") will be described with reference to FIG. 7, but the term "non-image-forming period" will be defined in advance. The apparatus main body 100 inputs image information in the form of documents or shapes that the user has optionally created, from an external device (computer or storage media) that is omitted from illustration. The control unit 103 controls each object of control to execute image formation by the apparatus main body 100 based on the input image information. This execution period is referred to as "image-forming period". On the other hand, after image formation has ended, such as when performing post-rotation operations or the like, initial operations before forming images based on image information, and maintenance operation execution periods unrelated to input of image information, are the "non-image-forming period".

The toner supply (purge) process is executed in the non-image-forming period when the photosensitive drum 10, developing roller 31, and so forth are being driven based on signals from the control unit 103. Accordingly, the toner supply (purge) process is controlled by the control unit 103.

The toner supply (purge) process is executed during post-rotation operations, which is during non-image-forming that is not during image forming (developing), in order to maintain the lubricity between the cleaning blade 12 and the photosensitive drum 10. Post-rotation operations are operations performed after image formation, to execute post-image-forming operations where driving of the main motor is continued for a certain amount of time after printing of the last sheet of recording material has ended and the photosensitive drum 10 is driven. In the toner supply (purge) process, a solid black toner band W is formed on the entire region on the photosensitive drum 10 in the longitudinal direction by the same processes of charging, exposing, and developing as the above-described image forming process of the photosensitive drum 10. Thereafter, the toner band W is made to pass by the transfer roller 41 to which transfer voltage of opposite polarity from that when forming images is applied, thereby supplying the greater part of the toner band W to the cleaning blade 12.

The toner 30 fed to the cleaning blade 12 in the form of the toner band W has a configuration where the external additive 30*b* of inorganic particles such as lubricants, charge-controlling agents, and so forth, have been added to resin particles 30*a* serving as a base, as described with reference to FIG. 5. However, the present inventors have found through study that even better lubrication effects can be obtained when the external additive 30*b* is present at the contact portion between the cleaning blade 12 and photosensitive drum 10. Accordingly, a state in which a predetermined amount of the external additive 30*b* is present at an edge portion 12E of the cleaning blade 12 needs to be maintained. This can be realized by increasing the frequency of performing the toner supply (purge) process, but the toner 30 used on the toner supply (purge) process is accommodated in the cleaning frame 14, and accordingly cannot be used for image formation. Accordingly, lubricity is preferably maintained while maximally suppressing the amount of toner used in the toner supply (purge) process.

Accordingly, a toner supply (purge) process where the amount of toner used in the toner supply (purge) process is maximally suppressed, and more toner is set aside for image formation, will be described below. This differs depending on the usage state of the developing cartridge 3 and cleaning cartridge 1.

Usage State of Developing Cartridge and Timing of Toner Purge

Figure 8A:
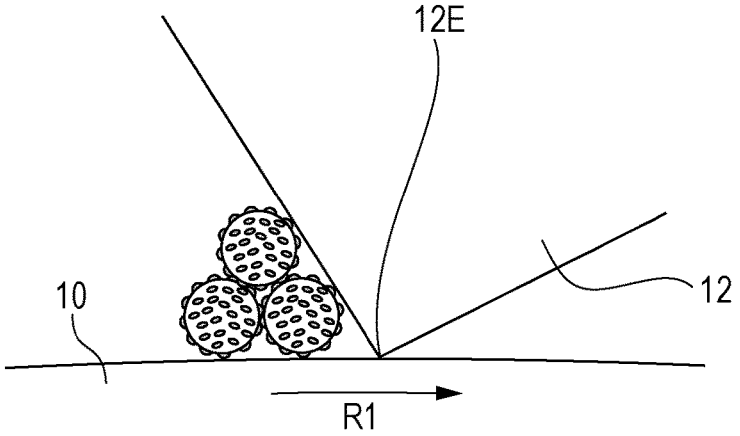
FIGS. 8A and 8B are diagrams for describing behavior of toner at an edge portion of a cleaning blade according to the first embodiment.
Figure 8B:
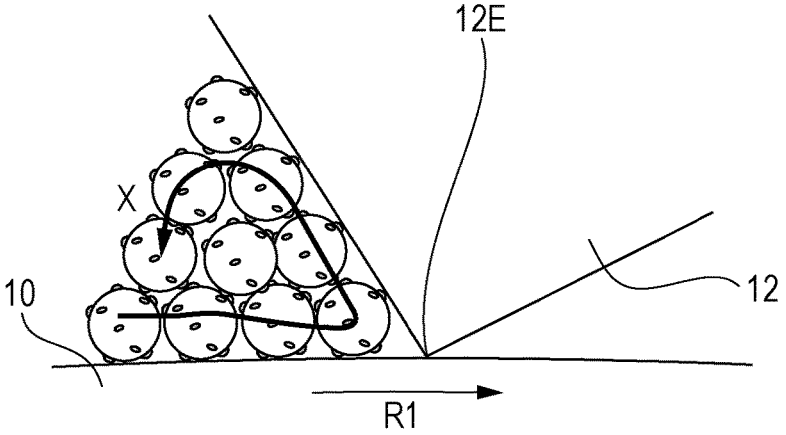

FIGS. 8A and 8B are diagrams schematically illustrating around the edge portion 12E (contact region) of the cleaning blade 12. When starting use of the developing cartridge 3, there is a great amount of the external additive 30*b* adhering to the toner 30. Accordingly, a sufficient amount of external additive 30*b* can be supplied to the edge portion 12E even if the amount of toner 30 being fed to the edge portion 12E of the cleaning blade 12 is small.

However, when the developing cartridge 3 continues to be used (the amount of use of the developing cartridge 3 increases), the toner 30 "deteriorates" due to repeated rubbing against the developing blade 32, supply roller 33, and so forth. The term "deterioration" as used here means that the external additive 30*b* comes loose from the resin particles 30*a*, or becomes embedded in the resin particles 30*a*. As deterioration of the toner 30 advances, the amount of external additive 30*b* moving to the cleaning blade 12 decreases and the lubricity thereof decreases, so the effects of reduced friction between the two is less readily maintained. Accordingly, there is a need to increase the amount of toner for each toner supply (purge) process, or to increase the frequency of performing the toner supply (purge) process, in the latter half of the endurance lifespan (latter half of the usage lifespan) where toner deterioration advances. In a case of increasing the amount of toner, a great amount of toner 30 is fed to the edge portion 12E of the cleaning blade 12 as illustrated in FIG. 8B, and the toner 30 is retained while moving in the direction of the arrow X, thereby ensuring lubricity. According to the above description, about how much toner 30 should be fed to the cleaning blade 12 in the toner supply (purge) process can be found if the degree of advance of toner deterioration within the developing cartridge 3 can be found.

According to the present embodiment, the number of rotations of the developing roller 31 is used as an index indicating the degree of advance of toner deterioration. The reason is that deterioration of the toner 30 advances primarily due to rubbing between the developing roller 31 and developing blade 32. The rotation speed of the developing roller 31 is constant, so the number of rotations of the developing roller 31 can be detected by adding up the drive time of the developing drive motor. The number of rotations of the developing roller 31 is calculated by detecting drive operations of the developing roller 31 and adding up from the time of starting usage without being reset. The amount of use of the developing roller 31 is calculated by the control unit 103 using the following Expression (1), where the amount of use when starting usage in 0%, and the number of rotations of a developing roller 31 that may exhibit defective images such as fogging, vertical streaks, and so forth, is 100%.

Current usage amount of developing roller (%)=accumulated number of rotations of developing roller/total number of rotations of developing roller at which defective images may occur×100 (1)

The calculated usage amount of the developing roller 31 is written to the storage element 37 by the control unit 103. The apparatus main body 100 (control unit 103) of the image forming apparatus can reference the amount of use of the developing roller 31 from the storage element 37 as necessary.

Current usage amount of developing roller (%)=drive time of developing roller so far/total drive time of developing roller at which defective images may occur×100 (2)

Usage State of Cleaning Cartridge and Timing to Supply Toner

When starting using the cleaning cartridge 1, there is absolutely no toner 30 on the edge portion 12E of the cleaning blade 12 and the surface of the photosensitive drum 10. Accordingly, the lubricity is low and the friction force between the cleaning blade 12 and photosensitive drum 10 is great. Accordingly, a predetermined amount of the external additive 30*b* is made to transition by the toner supply (purge) process, thereby securing lubricity. The amount of toner 30 supplied to be transitioned at this time is decided by the degree of deterioration of the toner 30, as described above.

In a state where the developing cartridge 3 is in a state close to the initial state of use (the number of rotations of the developing roller 31 is small), the amount of external additive 30*b* adhering to the toner is great. Accordingly, external additive 30*b* is fed to the edge portion 12E of the cleaning blade 12 by feeding just a small amount of toner 30 as illustrated in FIG. 8A, and lubricity is ensured. The cleaning cartridge 1 and developing cartridge 3 are independently detachably mountable in the present embodiment. Accordingly, there is a possibility that a developing cartridge 3 in the latter half of the usage lifespan where toner deterioration has advanced (great number of rotations of the developing roller 31) will be combined with a cleaning cartridge 1 in the initial stage of use. In this case, the amount of external additive 30*b* adhering to the toner has decreased, so a somewhat great amount of toner 30 needs to be fed to the edge portion 12E of the cleaning blade 12, as illustrated in FIG. 8B. This is in order to retain this toner 30 around the edge portion 12E of the cleaning blade 12 and circulate in the direction of the arrow X as illustrated in FIG. 8B, to secure lubricity.

Figure 9:
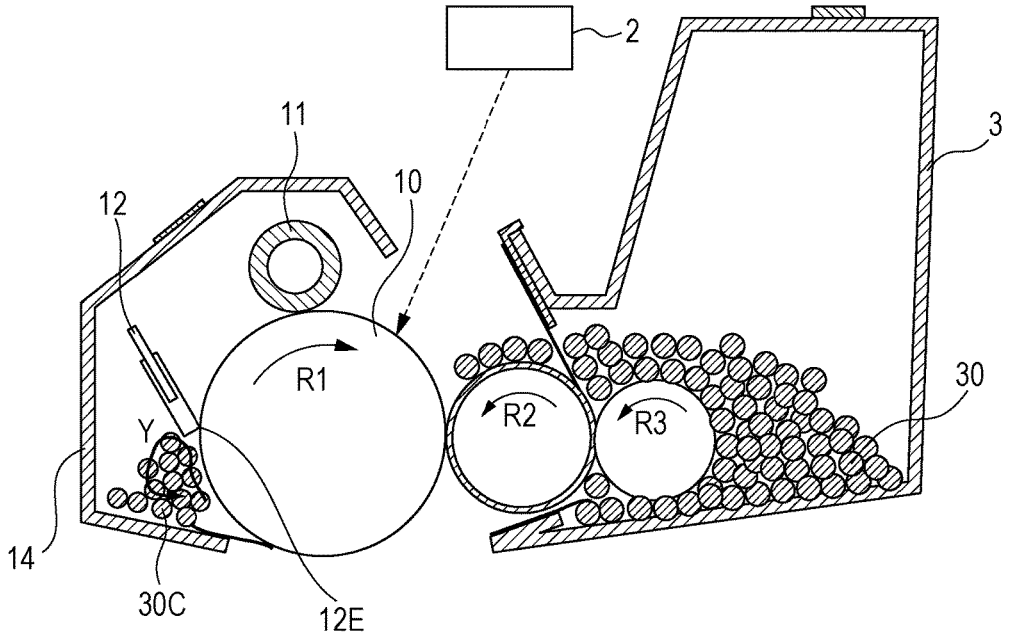
FIG. 9 is a diagram for describing the state of using a second developing cartridge according to the first embodiment.

When the use of the developing cartridge 3 advances and the lifespan of the first developing cartridge 3 used with the cleaning cartridge 1 approaches its end, it may be replaced with a second developing cartridge 3. When replaced with the second developing cartridge 3, the state is such as that illustrated in FIG. 9. That is to say, the toner 30 supplied in the toner supply (purge) process while the first developing cartridge 3 was still in use is retained around the edge portion 12E of the cleaning blade 12. Additionally, waste toner 30*c* from untransferred toner, fogging, and the like, is retained at the edge portion 12E of the cleaning blade 12 and circulates in the direction of the arrow Y. In this case, these serve to maintain lubricity, so a cleaning cartridge 1 where waste toner 30*c* has accumulated will have no problems due to reduced lubricity even if the amount of toner used in the toner supply (purge) process is reduced.

In the present embodiment, a measurement arrangement where the number of pixels of light emission of the exposing device 2 can be counted (pixel count) is used for calculation of the amount of waste toner 30*c*. This may be made up of the control unit 103, or may be provided separately from the control unit 103. A pixel count is counting individual image signals making up image dots of the formed image. The toner amount needed to develop a certain image is estimated by the control unit 103 from the number of pixels where the exposing device 2 emits light. The amount of waste toner 30*c* that passes around the cleaning blade 12 is a value obtained by multiplying the amount of actually-used toner by a certain percentage. Consumed waste toner 30*c* occurring in print errors such as jamming, and the toner supply (purge) process and so forth, is not externally output on recording sheets as images. That is to say, all pixels in the pixel count are waste toner, so the control unit 103 adds the pixel count where dots are actually counted as the amount of waste toner 30*c*. The percentage of accommodated waste toner 30*c* is calculated as follows.

Percentage of waste toner accommodated (%)=amount of waste toner calculated by pixel count/amount of waste toner that can be accommodated in cleaning frame×100 (2)

In a state where multiple developing cartridges 3 are used per one cleaning cartridge 1 (e.g. where multiple developing cartridges 3 are used with one cleaning cartridge 1), the control unit 103 records the total waste toner amount over the multiple developing cartridges 3, as a value relating to developing agent recovered by the cleaning member. That is to say, the control unit 103 stores the value relating to developing agent recovered by the cleaning member over multiple developing cartridges 3 in the storage element 13, and uses this for calculation. The amount of developing agent recovered by the cleaning member in the present specification is not only the amount of developing agent directly detected, but also includes the above-described waste toner accommodation percentage and waste toner amount as well.

As described above, in a configuration where two or more unused developing cartridges 3 can be used per one cleaning cartridge 1 as in the present embodiment, the amount of toner initially supplied from the second and subsequent developing cartridges 3 can be reduced. The amount of toner initially supplied means the amount of toner supplied from the developing cartridge 3 via the photosensitive drum 10 to the cleaning member when performing the toner supply (purge) process from an unused developing cartridge 3. That is to say, the amount of toner used in the first toner supply (purge) process performed with the second and subsequent developing cartridges 3 can be less than the amount of toner used in the first toner supply (purge) process performed with the first unused developing cartridge 3. Also, in a configuration where the number of printable sheets of the cleaning cartridge 1 is greater than the number of printable sheets of the developing cartridge 3, the amount of toner initially supplied can be reduced for the second and subsequent developing cartridges 3.

Deciding Supply Amount (Purge Amount) in Toner Supply (Purge) Process

Figure 10:
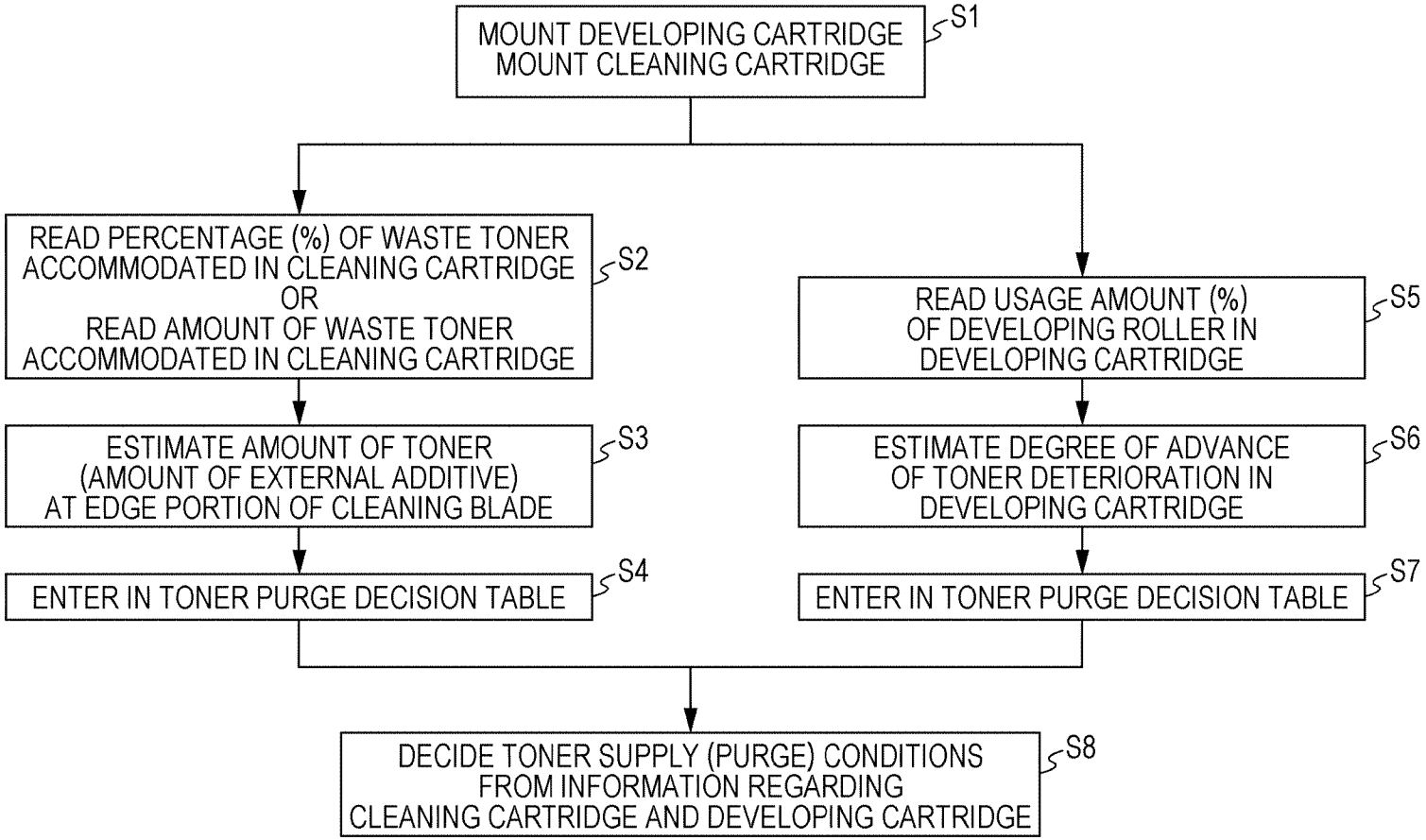
FIG. 10 is a flowchart regarding deciding conditions for toner supply (purging) according to the first embodiment.

The operation sequence at the time of performing toner supply (purge) processing in the image forming apparatus according to the first embodiment of the present invention will be described. FIG. 10 is a flowchart of when performing the toner supply (purge) processing. The cleaning cartridge 1 and developing cartridge 3 are mounted to the image forming apparatus, and the power of the image forming apparatus is turned on. The control unit 103 of the image forming apparatus detects that the cleaning cartridge 1 and developing cartridge 3 are mounted to the apparatus main body 100. The control unit 103 in the present embodiment also serves as a detecting unit that detects whether or not these are mounted (S1).

After the power to the image forming apparatus is turned on, the waste toner accommodation percentage (%) of waste toner within the cleaning frame 14 is read by the control unit 103 through communication between the storage element 13 provided to the cleaning cartridge 1 and a communication unit within the apparatus main body 100 (S2).

Next, the control unit 103 estimates around how much toner is present at the edge portion 12E of the cleaning blade 12. Estimation may be made of the amount of external additive instated (S3). The control unit 103 enters the estimated value (information) to a toner purge conditions decision table (S4).

In parallel, the control unit 103 reads the developing roller usage amount through communication between the storage element 37 provided to the developing cartridge 3 and the communication unit within the apparatus main body 100 (S5). Thereafter, the control unit 103 estimates the degree of advance of toner deterioration within the developing cartridge 3 (S6). The control unit 103 then enters information to the toner purge conditions decision table (S7).

The control unit 103 decides toner supply (purge) conditions (toner supply amount), based on the information entered from the cleaning cartridge 1 side and the developing cartridge 3 side in S4 and S7 (S8). The term "enter" as used here means processing using the information read from the storage elements 13 and 37 as parameters for identifying particular toner supply (purge) conditions from the toner purge conditions decision table.

The present inventors performed the following experiment to compile the toner purge conditions decision table. The present inventors used the apparatus main body 100 where the cleaning cartridge 1 and developing cartridge 3 are independently detachably mounted to perform endurance testing of the developing cartridge 3 with different waste toner amounts in the cleaning cartridge 1. The minimal toner supply (purge) amount where no abnormal noise due to chattering (vibration) of the cleaning blade 12 occurs to the end of the endurance test, with one toner supply (purge) processing performed every predetermined number of sheets, was investigated.

Conditions

- Two-sheet intermittent endurance test at temperature of 10° C. and humidity of 10%, up to 5,000 sheets at 0.3% coverage
- Endurance tests performed five times, at waste toner accommodation percentages of 0, 20, 40, 60, and 80%
- Toner supply (purge) processing performed once every 100 sheets
- Process speed of 100 mm/sec

TABLE

| | | Waste toner accommodation percentage | | | | |
|---|---|---|---|---|---|---|
| | | Endurance test 1 0% | Endurance test 2 20% | Endurance test 3 40% | Endurance test 4 60% | Endurance test 5 80% |
| Usage amount of developing roller | 0% | 10 mg | 8 mg | 5 mg | 3 mg | 3 mg |
| | 20% | 13 mg | 10 mg | 7 mg | 6 mg | 6 mg |
| | 40% | 22 mg | 19 mg | 15 mg | 13 mg | 12 mg |
| | 60% | 45 mg | 34 mg | 28 mg | 24 mg | 22 mg |
| | 80% | 75 mg | 63 mg | 50 mg | 38 mg | 33 mg |

The Table illustrates the amount of toner (mg) consumed in one toner supply (purge) processing under the above-described conditions. Under these conditions, no abnormal noise occurs. Accordingly, what is shown in the Table can be used as the toner purge conditions decision table without change. That is to say, the Table is an example of the toner purge conditions decision table.

It can also be seen from the Table that in a case for the same usage amount of the developing cartridge 3 (i.e. for a fixed usage amount of the developing cartridge 3), for increasing amounts of developing agent recovered by the cleaning member, the toner supply amount decreases. For example, for a usage amount of the developing cartridge of 40%, it can be seen that as the amount of developing agent recovered by the cleaning member increases from 0% to 80%, the toner supply amount decreases from 22 mg to 12 mg. In a case for the same amount of developing agent recovered by the cleaning member (i.e. for a fixed amount of developing agent recovered by the cleaning member), for increasing usage amounts of the developing cartridge 3, the toner supply amount increases. For example, for an amount of developing agent recovered by the cleaning member of 40%, it can be seen that as the usage amount of the developing cartridge increases from 0% to 80%, the toner supply amount increases from 5 mg to 50 mg. According to the experiment results in the Table, it can be seen that in a case of an image forming apparatus that can use five developing cartridges 3 for one cleaning cartridge 1, the amount of toner consumed in the toner supply (purge) processing can be reduced as the number of cleaning cartridges 1 used increases.

Note that in this experiment, verification was performed using a method where the toner supply (purge) processing was performed every predetermined number of sheets, and the toner supply (purge) amount was changed for each toner supply (purge) processing. However, this is not restrictive, and the same advantages can be anticipated if the toner supply (purge) amount per increment of sheets can be reduced more the greater the waste toner accommodation percentage is.

The control unit 103 compares signals corresponding to the amount of developing agent recovered by the cleaning member and signals corresponding to the amount of use of the developing cartridge 3, with a reference table stored within the image forming apparatus, and decides the toner supply amount. The above-described toner purge conditions decision table is an example of the reference table.

Note that while the toner usage amount of the developing roller 31 defined by Expressions (1) and (2) is used for the vertical axis in the toner purge conditions decision table in the Table, the present embodiment is not restricted to this. Any value can be used as appropriate if relating to the amount of usage of the developing roller 31 (developing cartridge 3). For example, the usage amount may be the number of rotations of the developing roller 31, or time itself. The toner purge conditions decision table may use the remaining drive amount of the developing roller 31 for the vertical axis instead of the usage amount of the developing roller 31. The remaining drive amount (remaining life) of the developing roller 31 can be said to be a value relating to the usage amount of the developing roller 31 (developing cartridge 3). In this case, a value obtained by subtracting the accumulated number of rotations of the developing roller 31 from the total number of rotations of a developing roller 31 where defective images may occur, and a percentage value obtained by multiplying the ratio by 100, are equivalent to the remaining drive amount of the developing roller 31 (developing cartridge 3).

The horizontal axis in the toner purge conditions decision table is not restricted to the waste toner accommodation percentage, either. Any value can be used as appropriate, as long as a value relating to the amount of developing agent recovered as waste toner. For example, this may be the waste toner amount, remaining waste toner accommodation capacity, or remaining waste toner accommodation percentage. Either of the remaining waste toner accommodation capacity and remaining waste toner accommodation percentage can be equivalent to a value relating to the amount of developing agent recovered by the cleaning member as waste toner.

Although description has been made above that the waste toner amount is an amount based on the pixel count, this is not restrictive. The waste toner amount may be detected by known mechanical or optical sensors, and the output value thereof may be read by the control unit 103 to perform estimation. That is to say, the sensor value detected in this way can be equivalent to a value relating to the amount of developing agent recovered by the cleaning member.

Further, the toner purge conditions decision table in the Table has the waste toner accommodation percentage as the horizontal axis, but this is not restrictive. Another amount may be employed as long as a value relating to the waste toner amount. For example, if there is a certain macroscopic correlation between the amount of waste toner passing around the cleaning blade 12 and the amount of toner actually used, the total usage amount of multiple developing cartridges 3 mounted and operated with regard to one cleaning cartridge 1 may be employed. Such a value can also be equivalent to a value relating to the amount of developing agent recovered by the cleaning member. The above modifications are also equally applicable to the following embodiments.

Second Embodiment

Figure 11:
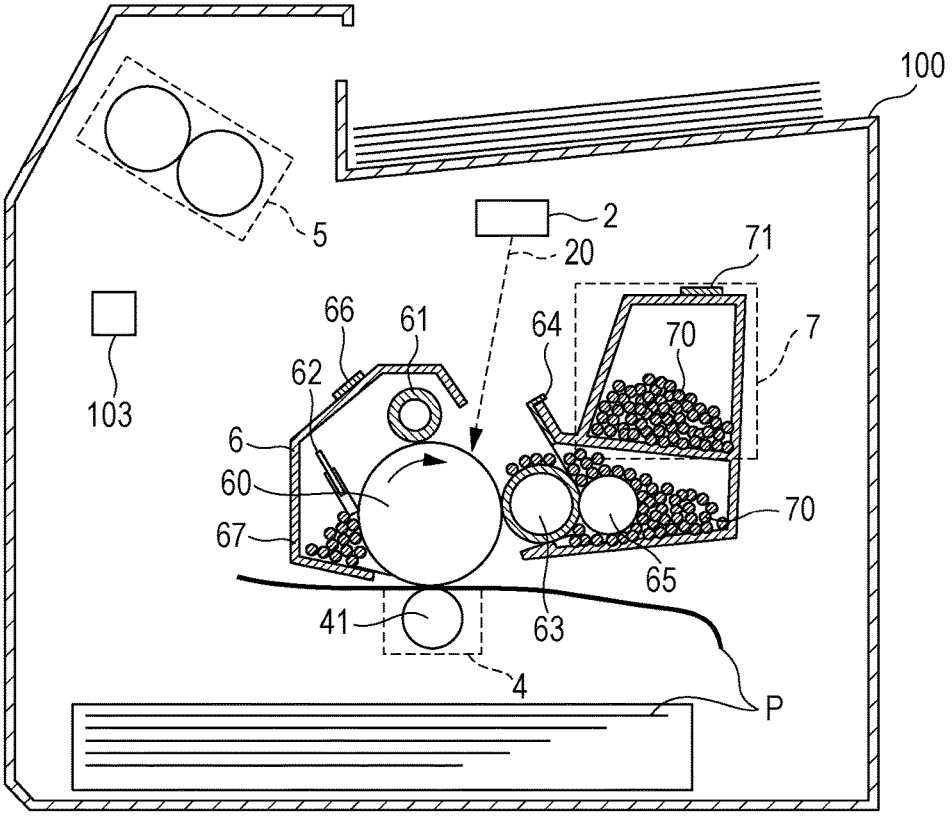
FIG. 11 is a diagram for describing an image forming apparatus according to a second embodiment.

A second embodiment of the present invention will be described with reference to FIG. 11. Note that components that are different from those in the first embodiment will be described in the present embodiment, and description of components that are the same as in the first embodiment will be omitted.

A feature of the present embodiment is that a process cartridge including a photosensitive drum, charging device, developing device, and cleaning device, and a toner cartridge containing toner, are each independently detachably mounted. The present invention is applicable to such a form as well.

The image forming apparatus has at least a process cartridge 6, an exposing device 2, a toner cartridge 7, a transfer device 4, and a fixing device 5, within the apparatus main body 100. The process cartridge 6 and toner cartridge 7 are independently detachably mounted to the apparatus main body 100 in the present embodiment.

The process cartridge 6 includes a photosensitive drum 60 serving as an image bearing member, a charging roller 61 serving as a charging member, and a cleaning blade 62 serving as a cleaning member. The process cartridge 6 further includes a developing roller 63, a developing blade 64, a supply roller 65, and a storage element 66 that is communicable with the image forming apparatus, within a process cartridge frame 67. The toner cartridge 7 has at least toner 70 and a storage element 71 that is communicable with the image forming apparatus within a toner cartridge frame 72.

The reason that the process cartridge 6 and toner cartridge 7 are each independently detachably mounted in this way is in order to efficiently use both cartridges until the end of their lifespans. Accordingly, a configuration where around three to seven toner cartridges 7 are used for one process cartridge 6 is common.

Toner Supply (Purge) Process in Non-Image-Forming Period

In this embodiment as well, the timing to perform the toner supply (purge) processing can be decided in accordance with the usage state of the toner cartridge 7 and process cartridge 6.

Usage State of Toner Cartridge and Toner Supply Conditions

As described in the first embodiment, the toner supply amount necessary in the toner supply (purge) processing can be found if the degree of advance of toner deterioration can be found. While the degree of advance of toner deterioration has been detected by the number of rotations of the developing roller 31 in the first embodiment, the degree of advance of toner deterioration can be also detected by the remaining amount of toner 70 within the developing device, besides this method. In a case where the remaining amount of toner 70 is great in FIG. 11, a great amount a fresh toner 70 that has not deteriorated is supplied from the supply roller 65 to the developing roller 63. As usage of the developing roller 63 advances and the remaining amount of toner 70 decreases, the probability that there will be toner 70 that has been rubbed by the developing blade 64 in the past upon the developing roller 63 increases. The frequency of rubbing by the developing blade 64 and so forth of the toner 70 correlates with the degree of advance of toner deterioration. Accordingly, detecting the remaining amount of toner 70 enables the degree of advance of toner deterioration to be detected as well.

In the present embodiment, the remaining amount of toner is stored in the storage element 71 attached to the toner cartridge 7, and the degree of advance of deterioration is determined by the remaining amount of toner. The initial value of the remaining amount of toner is the toner filling amount (toner amount) within the toner cartridge 7 at the initial point (unused state). A method is used where the initial value is stored in the storage element 71, a toner amount corresponding to the pixel count based on image signals is calculated therefrom, and subtracted from the initial value. The remaining toner amount of the toner cartridge 7 and the usage amount of the toner cartridge 7 are the same in the present embodiment.

Usage State of Cleaning Cartridge and Toner Supply Conditions

If the waste toner amount within the process cartridge 6 can be found, the amount of toner 70 that should be fed to the cleaning blade 12 in the toner supply (purge) processing can be judged. The method where the waste toner amount is calculated from the pixel count is used in the present embodiment as well.

Deciding Purge Amount in Toner Supply (Purge) Processing

Figure 12:
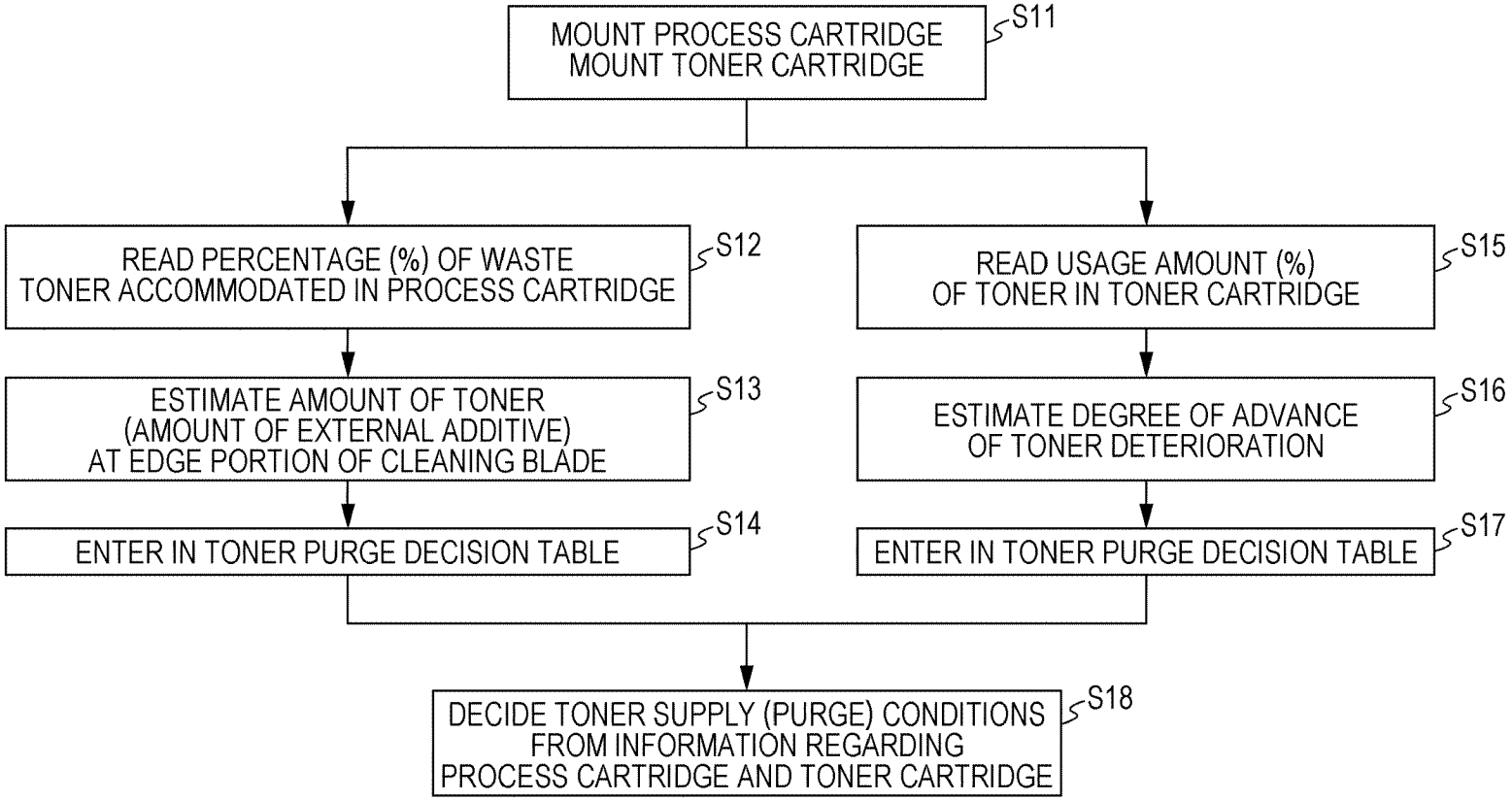
FIG. 12 is a flowchart regarding deciding conditions for toner supply (purging) according to the second embodiment.

An operation sequence of performing toner supply (purge) processing in the image forming apparatus according to the second embodiment of the present invention will be described. FIG. 12 is a flowchart of when performing the toner supply (purge) processing. The process cartridge 6 and toner cartridge 7 are mounted to the image forming apparatus, the control unit 103 detects that these are mounted, and if mounting has been confirmed by the control unit 103, the flow advances (S11).

The waste toner accommodation percentage (%) within the process cartridge frame 67 is read by the control unit 103 through communication between the storage element 66 provided to the process cartridge 6 and the communication unit within the apparatus main body 100 (S12).

In a state where multiple toner cartridges 7 are used for one process cartridge 6, the control unit 103 records the total waste toner amount over the multiple toner cartridges 7 as a value relating to the developing agent recovered by the cleaning member. That is to say, the control unit 103 stores a value relating to the developing agent recovered by the cleaning member over multiple toner cartridges 7 in the storage element 66, and uses this for computation.

Based on the read information, the control unit 103 estimates around how much toner is present at the edge portion 12E of the cleaning blade 12 (S13). The control unit 103 enters the estimated value (information) to the toner purge conditions decision table (S14).

In parallel, the control unit 103 reads the toner remaining amount or usage amount through communication between the storage element 71 provided to the toner cartridge 7 and the communication unit within the apparatus main body 100 (S15). The way of obtaining the waste toner accommodation percentage is the same as described in the first embodiment, but the usage amount (%) in the toner cartridge 7 may be calculated by the control unit 103 based on the pixel count value, or an output value from a known optical sensor may be obtained. Thereafter, the control unit 103 estimates the degree of advance of toner deterioration within the toner cartridge 7 (S16). The control unit 103 then enters information to the toner purge conditions decision table (S17). The toner supply conditions are decided based on the information entered from the process cartridge 6 side and the toner cartridge 7 side in S14 and S17 (S18).

The amount of toner consumed in the toner supply (purge) processing is decided by the above-described flowchart in the second embodiment as well, so advantages the same as those of the first embodiment can be anticipated.

Others

There are toner carriages that accommodate developing agent, developing cartridges that include at least a developing agent bearing member, and further cleaning cartridges that include at least a cleaning member. Further, there are process cartridges that have at least an image bearing member and process arrangements that act thereupon, and so forth.

Now, there are arrangements where a developing cartridge itself has a frame accommodating developing agent, and once the accommodated developing agent is used up, the developing cartridge itself is replaced. A developing cartridge may have a configuration where a toner cartridge that accommodates developing agent is detachably mounted separately from the developing cartridge. In this case, the developing cartridge has a configuration where developing agent can be supplied from the toner cartridge to a space in a frame supporting the developing agent bearing member where developing agent can be accommodated.

A cleaning cartridge has an image bearing member and a cleaning member that cleans the image bearing member. In many cases, when the cleaning cartridge is mounted to the apparatus main body, the developing cartridge also needs to be mounted to the apparatus main body. This is the arrangement in the first embodiment.

It is sufficient for a process cartridge to have at least an image bearing member. In many cases, a process cartridge refers to a configuration having a charging unit that charges the image bearing member, and a developing unit that develops an electrostatic image on the image bearing member. A toner cartridge for supplying toner to the process cartridge may further have a detachably mounted configuration. This is the arrangement in the second embodiment.

The apparatus main body of the image forming apparatus may have a configuration where a process cartridge is detachably mounted, or may have a configuration where a developing cartridge and cleaning cartridge are detachably mounted. Further, in the case of two cartridges, a configuration may be made where the developing cartridge is attached to the cleaning cartridge and then mounted to the apparatus main body of the image forming apparatus, or where the cartridges can be mounted to the apparatus main body regardless of the mounting state of other cartridges.

According to the above embodiments, an image forming apparatus can be provided where the amount of developing agent fed to the cleaning member is reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-031353 filed on Feb. 22, 2017, which is hereby incorporated by reference herein in its entirety.

What is claimed is:

1. An image forming apparatus comprising:

a cleaning cartridge including an image bearing member, and a cleaning member configured to come into contact with the image bearing member and clean the image bearing member;

a developing cartridge having a developing agent bearing member configured to convey developing agent to the image bearing member; and a control unit configured to execute a supply process of developing agent supplied from the developing cartridge to the cleaning member via the image bearing member during a non-image-forming period, wherein the cleaning cartridge and the developing cartridge are each detachably mounted to an apparatus main body of the image forming apparatus, wherein the control unit decides, based on a value relating to an amount of developing agent recovered by the cleaning member and a value relating to a usage amount of the developing cartridge, a supply amount of the developing agent supplied from the developing cartridge to the cleaning member in the supplying process of the developing agent, and wherein, in a case where the usage amount of the developing cartridge is fixed, for increasing amounts of developing agent recovered by the cleaning member, the supply amount of the developing agent decreases.

2. The image forming apparatus according to claim 1, wherein two or more unused developing cartridges can be used per one cleaning cartridge, and wherein the control unit decides, with regard to a plurality of developing cartridges, the supply amount of developing agent based on a value relating the amount of developing agent recovered by the cleaning member and a value relating to the usage amount of the developing cartridge.

3. The image forming apparatus according to claim 1, wherein, in a case where the amount of developing agent recovered by the cleaning member is fixed, for increasing usage amounts of the developing cartridge, the supply amount of the developing agent increases.

4. The image forming apparatus according to claim 1, further comprising an exposing device configured to emit light based on image signals to form electrostatic latent image on a surface of the image bearing member, wherein the electrostatic latent image is developed by the developing agent conveyed by the developing agent bearing member, wherein the value relating to the amount of developing agent recovered by the cleaning member includes a value estimated based on a pixel count corresponding to light emission by the exposing device.

5. An image forming apparatus comprising:

a cleaning cartridge including an image bearing member, and a cleaning member configured to come into contact with the image bearing member and clean the image bearing member;

a developing cartridge having a developing agent bearing member configured to convey developing agent to the image bearing member;

a control unit configured to execute a supply process of developing agent supplied from the developing cartridge to the cleaning member via the image bearing member during a non-image-forming period; and an exposing device configured to emit light based on image signals to form electrostatic latent image on a surface of the image bearing member, wherein the electrostatic latent image is developed by the developing agent conveyed by the developing agent bearing member, wherein the cleaning cartridge and the developing cartridge are each detachably mounted to an apparatus main body of the image forming apparatus, wherein the control unit decides, based on a value relating to an amount of developing agent recovered by the cleaning member and a value relating to a usage amount of the developing cartridge, a supply amount of the developing agent supplied from the developing cartridge to the cleaning member in the supplying process of the developing agent, and wherein the value relating to the amount of developing agent recovered by the cleaning member includes a value estimated based on a pixel count corresponding to light emission by the exposing device.

6. The image forming apparatus according to claim 5, wherein, in a case where the usage amount of the developing cartridge is fixed, for increasing amounts of developing agent recovered by the cleaning member, the supply amount of the developing agent decreases.

7. The image forming apparatus according to claim 5, wherein two or more unused developing cartridges can be used per one cleaning cartridge, and wherein the control unit decides, with regard to a plurality of developing cartridges, the supply amount of developing agent based on a value relating the amount of developing agent recovered by the cleaning member and a value relating to the usage amount of the developing cartridge.

8. The image forming apparatus according to claim 5, wherein, in a case where the amount of developing agent recovered by the cleaning member is fixed, for increasing usage amounts of the developing cartridge, the supply amount of the developing agent increases.

9. An image forming apparatus comprising:

a cleaning cartridge including an image bearing member, and a cleaning member configured to come into contact with the image bearing member and clean the image bearing member;

a developing cartridge having a developing agent bearing member configured to convey developing agent to the image bearing member; and a control unit configured to execute a supply process of developing agent supplied from the developing cartridge to the cleaning member via the image bearing member during a non-image-forming period, wherein the cleaning cartridge and the developing cartridge are each detachably mounted to an apparatus main body of the image forming apparatus, wherein the control unit decides, based on a value relating to an amount of developing agent recovered by the cleaning member and a value relating to a usage amount of the developing cartridge, a supply amount of the developing agent supplied from the developing cartridge to the cleaning member in the supplying process of the developing agent, wherein two or more unused developing cartridges can be used per one cleaning cartridge, and wherein, with regard to one cleaning cartridge, the supply amount at an initial point in the supply process of developing agent after having mounted a first unused developing cartridge to the apparatus main body is more than the supply amount at the initial point in the supply process of developing agent after having mounted a second or subsequent unused developing cartridge to the apparatus main body.

10. The image forming apparatus according to claim 9, wherein, in a case where the usage amount of the developing cartridge is fixed, for increasing amounts of developing agent recovered by the cleaning member, the supply amount of the developing agent decreases.

11. The image forming apparatus according to claim 9, wherein, in a case where the amount of developing agent recovered by the cleaning member is fixed, for increasing usage amounts of the developing cartridge, the supply amount of the developing agent increases.

12. The image forming apparatus according to claim 9, further comprising an exposing device configured to emit light based on image signals to form electrostatic latent image on a surface of the image bearing member, wherein the electrostatic latent image is developed by the developing agent conveyed by the developing agent bearing member, wherein the value relating to the amount of developing agent recovered by the cleaning member includes a value estimated based on a pixel count corresponding to light emission by the exposing device.

13. An image forming apparatus comprising:

a process cartridge including an image bearing member, a cleaning member configured to come into contact with the image bearing member and clean the image bearing member, and a developing agent bearing member configured to convey developing agent to the image bearing member;

a toner cartridge configured to supply developing agent to the developing agent bearing member; and a control unit configured to execute a supply process of developing agent supplied from the developing agent bearing member to the cleaning member via the image bearing member during a non-image-forming period, wherein the process cartridge is detachably mounted to an apparatus main body of the image forming apparatus, wherein the control unit decides, based on a value relating to an amount of developing agent recovered by the cleaning member and a value relating to a usage amount of the toner cartridge, a supply amount of the developing agent supplied from the developing agent bearing member to the cleaning member in the supplying process of the developing agent, and wherein, in a case where the usage amount of the toner cartridge is fixed, for increasing amounts of developing agent recovered by the cleaning member, the supply amount of the developing agent decreases.

14. The image forming apparatus according to claim 13, wherein two or more unused toner cartridges can be used as to one process cartridge, and wherein, with regard to a plurality of toner cartridges, the control unit decides the supply amount of developing agent based on a value relating to the amount of developing agent recovered by the cleaning member and a value relating to the usage amount of the toner cartridge.

15. The image forming apparatus according to claim 13, wherein, in a case where the amount of developing agent recovered by the cleaning member is fixed, for increasing usage amounts of the toner cartridge, the supply amount of the developing agent increases.

16. The image forming apparatus according to claim 13, wherein two or more unused toner cartridges can be used per one process cartridge, and wherein, with regard to one process cartridge, the supply amount at an initial point in the supply process of developing agent after having mounted a first unused toner cartridge to the apparatus main body is more than the supply amount at the initial point in the supply process of developing agent after having mounted a second or subsequent unused toner cartridge to the apparatus main body.

17. An image forming apparatus comprising:

a process cartridge including an image bearing member, a cleaning member configured to come into contact with the image bearing member and clean the image bearing member, and a developing agent bearing member configured to convey developing agent to the image bearing member;

a toner cartridge configured to supply developing agent to the developing agent bearing member; and a control unit configured to execute a supply process of developing agent supplied from the developing agent bearing member to the cleaning member via the image bearing member during a non-image-forming period, wherein the process cartridge is detachably mounted to an apparatus main body of the image forming apparatus, wherein the control unit decides, based on a value relating to an amount of developing agent recovered by the cleaning member and a value relating to a usage amount of the toner cartridge, a supply amount of the developing agent supplied from the developing agent bearing member to the cleaning member in the supplying process of the developing agent, and wherein the value relating to the amount of developing agent recovered by the cleaning member includes a value estimated based on a pixel count corresponding to image signals.

18. The image forming apparatus according to claim 17, wherein, in a case where the usage amount of the toner cartridge is fixed, for increasing amounts of developing agent recovered by the cleaning member, the supply amount of the developing agent decreases.

19. The image forming apparatus according to claim 17, wherein two or more unused toner cartridges can be used as to one process cartridge, and wherein, with regard to a plurality of toner cartridges, the control unit decides the supply amount of developing agent based on a value relating to the amount of developing agent recovered by the cleaning member and a value relating to the usage amount of the toner cartridge.

20. The image forming apparatus according to claim 17, wherein two or more unused toner cartridges can be used per one process cartridge, and wherein, with regard to one process cartridge, the supply amount at an initial point in the supply process of developing agent after having mounted a first unused toner cartridge to the apparatus main body is more than the supply amount at the initial point in the supply process of developing agent after having mounted a second or subsequent unused toner cartridge to the apparatus main body.

* * * * *